US007637717B2

(12) United States Patent
Oh et al.

(10) Patent No.: US 7,637,717 B2
(45) Date of Patent: Dec. 29, 2009

(54) FAN ASSEMBLY TO DAMPEN FAN VIBRATION

(75) Inventors: Pil-yong Oh, Suwon-si (KR); Jun-seok Park, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 572 days.

(21) Appl. No.: 11/427,916

(22) Filed: Jun. 30, 2006

(65) Prior Publication Data

US 2007/0020120 A1 Jan. 25, 2007

(30) Foreign Application Priority Data

Jul. 7, 2005 (KR) ..... 10-2005-0061395

(51) Int. Cl.
*F04D 29/66* (2006.01)

(52) U.S. Cl. ..... 415/119; 415/214.1

(58) Field of Classification Search ..... 415/213.1
See application file for complete search history.

(56) References Cited

U.S. PATENT DOCUMENTS

RE31,820 E * 1/1985 Litch, III ..... 219/93
4,568,243 A * 2/1986 Schubert et al. ..... 415/213.1
5,017,328 A 5/1991 Mazurek
5,186,605 A * 2/1993 Tracy ..... 601/2
5,713,790 A * 2/1998 Lin ..... 454/184
7,189,053 B2 * 3/2007 Winkler et al. ..... 415/108
7,306,425 B2 * 12/2007 Park et al. ..... 415/119

FOREIGN PATENT DOCUMENTS

| | | |
|---|---|---|
| CN | 1605758 | 4/2005 |
| EP | 0236720 | 9/1987 |
| JP | 2000027799 A * | 1/2000 |
| JP | 2002-52913 | 2/2002 |
| KR | 2000-1110 | 1/2000 |

OTHER PUBLICATIONS

Chinese Office Action dated Jan. 4, 2008 issued in CN 2006-101156366.

* cited by examiner

*Primary Examiner*—Richard Edgar
(74) *Attorney, Agent, or Firm*—Stanzione & Kim, LLP

(57) ABSTRACT

A fan assembly includes a fan, a supporting case to support at least a part of the fan along a circumferential direction of the fan, and a vibration-proof member having at least one opening passing through a side thereof and interposed between the fan and the supporting case, to prevent noise from being generated from the fan. The fan assembly can efficiently prevent or dampen vibration generated by the fan and reduce noise.

20 Claims, 5 Drawing Sheets

FAN ASSEMBLY TO DAMPEN FAN VIBRATION

CROSS-REFERENCE TO RELATED APPLICATIONS

This application claims priority under 35 U.S.C. § 119 from Korean Patent Application No. 2005-61395, filed on Jul. 7, 2005, in the Korean Intellectual Property Office, the disclosure of which is incorporated herein in its entirety.

BACKGROUND OF THE INVENTION

1. Field of the Invention

The present general inventive concept relates to a fan assembly, and more particularly, to a fan assembly in which a vibration-proof structure of a fan is improved.

2. Description of the Related Art

As modern society has become an information and communication society, multimedia technology has been rapidly developing. Thus, an interest in and importance of a display apparatus has increased. In particular, research and development of the display apparatus including a display element, such as a Liquid Crystal Display (LCD), a Plasma Display Panel (PDP) TV, a Cathode Ray Tube (CRT), a Digital Micromirror Display (DMD) and etc., has been actively advanced.

Such a display apparatus is provided with a built-in printed circuit board (PCB). A large number of high-integrated electronic components are mounted on the PCB using a development of semiconductor technology. Thus, since an amount of heat generated from the electronic components is relatively increased, the amount of heat that is dissipated from the electronic components in order to operate normally is limited by using an existing natural cooling method.

To overcome this limitation, a forced-draft cooling method employing a fan is used. As an example, Korean Patent First Publication No. 2005-33339 discloses a conventional fan assembly including a fan, a supporting case for supporting the fan, a vibration-proof member interposed between the fan and the supporting case.

Herein, the vibration-proof member is in contact with the fan and prevents a vibration of the fan from being transmitted to the supporting case, thereby reducing noise generated by the vibration of the fan.

In the conventional fan assembly, since the vibration-proof member is formed of rubber, if a new structure capable of reducing a spring constant of the vibration-proof member can be provided to improve vibration prevention efficiency, the noise generated by the vibration of the fan can be further reduced.

SUMMARY OF THE INVENTION

The present general inventive concept provides a fan assembly which can efficiently prevent or dampen vibration generated from a fan and reduce noise.

Additional aspects and/or advantages of the present general inventive concept will be set forth in part in the description which follows and, in part, will be obvious from the description, or may be learned by practice of the present invention.

The foregoing and/or other aspects of the present general inventive concept can be achieved by providing a fan assembly, comprising a fan, a supporting case to support at least a part of the fan along a circumferential direction of the fan, and a vibration-proof member having at least one opening passing through a side thereof and interposed between the fan and the supporting case to prevent noise from being generated from the fan.

The vibration-proof member may be formed with an accommodating portion which engages with the at least a part of the fan along the circumferential direction of the fan.

The vibration-proof member may comprise a pair of vibration-proof parts that are respectively coupled to two opposite sides of the fan, and the opening is formed to pass through a lateral surface of each of the vibration-proof parts.

The supporting case may comprise a pair of supporting case parts to engage with each other and envelop the fan.

The fan assembly may further comprise a protrusion provided in one of the pair of supporting case parts, and a protrusion accommodating portion provided in the other one thereof to be coupled to the protrusion.

The vibration-proof member may be made of a rubber material.

The foregoing and/or other aspects of the present general inventive concept can also be achieved by providing an image projecting apparatus comprising a fan assembly including a fan, a supporting case to support at least a part of the fan along a circumferential direction of the fan, and a vibration-proof member having at least one opening passing through a side thereof and interposed between the fan and the supporting case to prevent noise from being generated from the fan.

The foregoing and/or other aspects of the present general inventive concept can also be achieved by providing a fan envelope to support a fan, the fan envelope comprising a supporting case to surround and support the fan, and a vibration-proof member to dampen vibrations of the fan, the vibration-proof member being disposed between the fan and the supporting case and having at least one opening passing through a side thereof.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
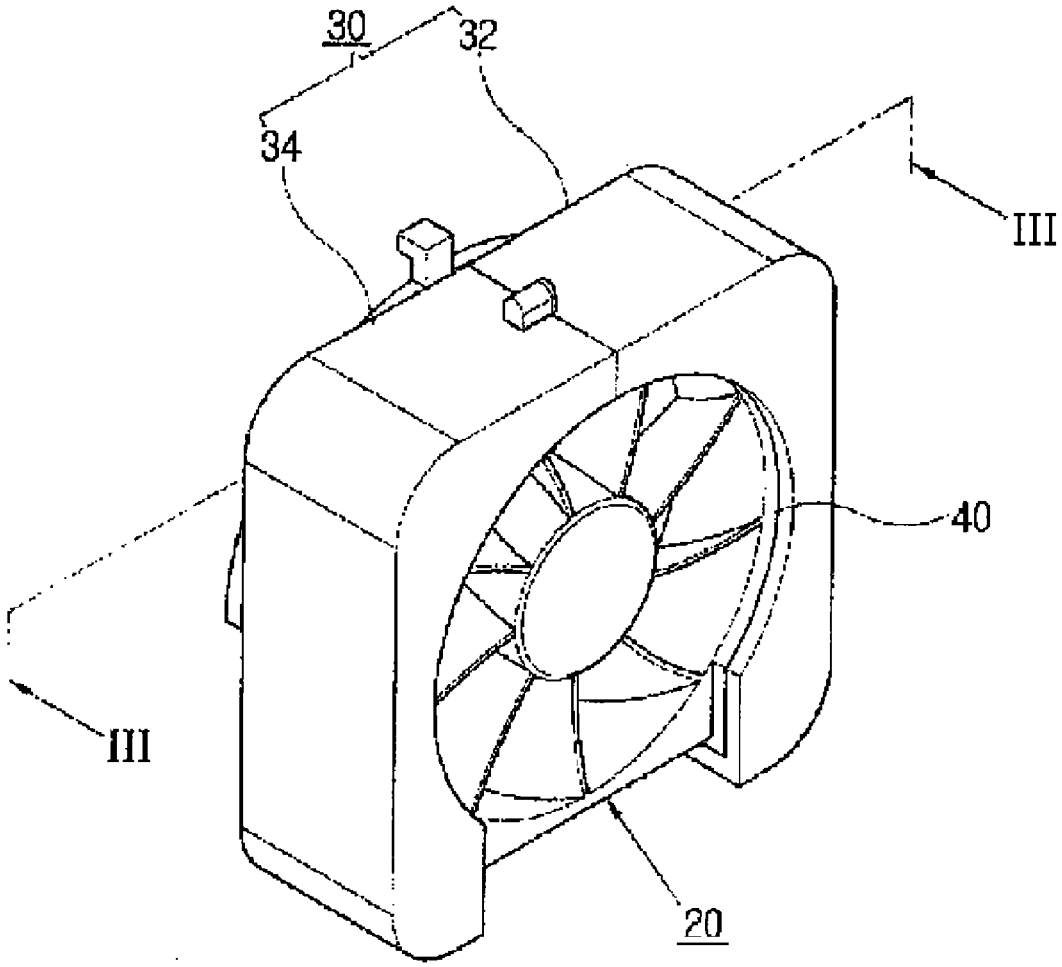
FIG. 1 is a perspective view of a fan assembly according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

As illustrated in FIG. 1, a fan assembly according to an embodiment of the present general inventive concept includes a fan 20, a supporting case 30 provided with first and second supporting case parts 32 and 34 to support the fan 20 along a circumferential direction thereof, and a vibration-proof member 40 interposed between the supporting case 30 and the fan 20 to prevent noise from being generated due to a vibration of the fan 20.

The fan 20 serves to blow cold air towards heat generating components, or to inhale heated air surrounding the heat generating components, thereby cooling the heat generating components.

The fan 20 includes a blade 26 to rotate, a fan housing 22 to support the blade 26, and a rotational shaft 24 rotated by driving means (not shown) and transmitting a rotational force to the blade 26.

The supporting case 30 includes the first supporting case part 32 that covers one side of the fan 20, and the second supporting case part 34 that covers the other side of the fan 20. Herein, the first and second supporting case parts 32 and 34 support the fan 20 while being in close contact with the fan 20 through a pressing force of the vibration-proof member 40.

The first and second supporting case parts 32 and 34 detachably couple to each other by coupling units 33 and 35.

The coupling units 33 and 35 include at least one protrusion 33 formed at the first supporting case part 32, and at least one protrusion-accommodating part 35 formed at the second supporting case part 34 to accommodate the protrusion 33. Therefore, the first and second supporting case parts 32 and 34 can be detachably coupled facing each other by the protrusion 33 and the protrusion-accommodating part 35.

Figure 2:
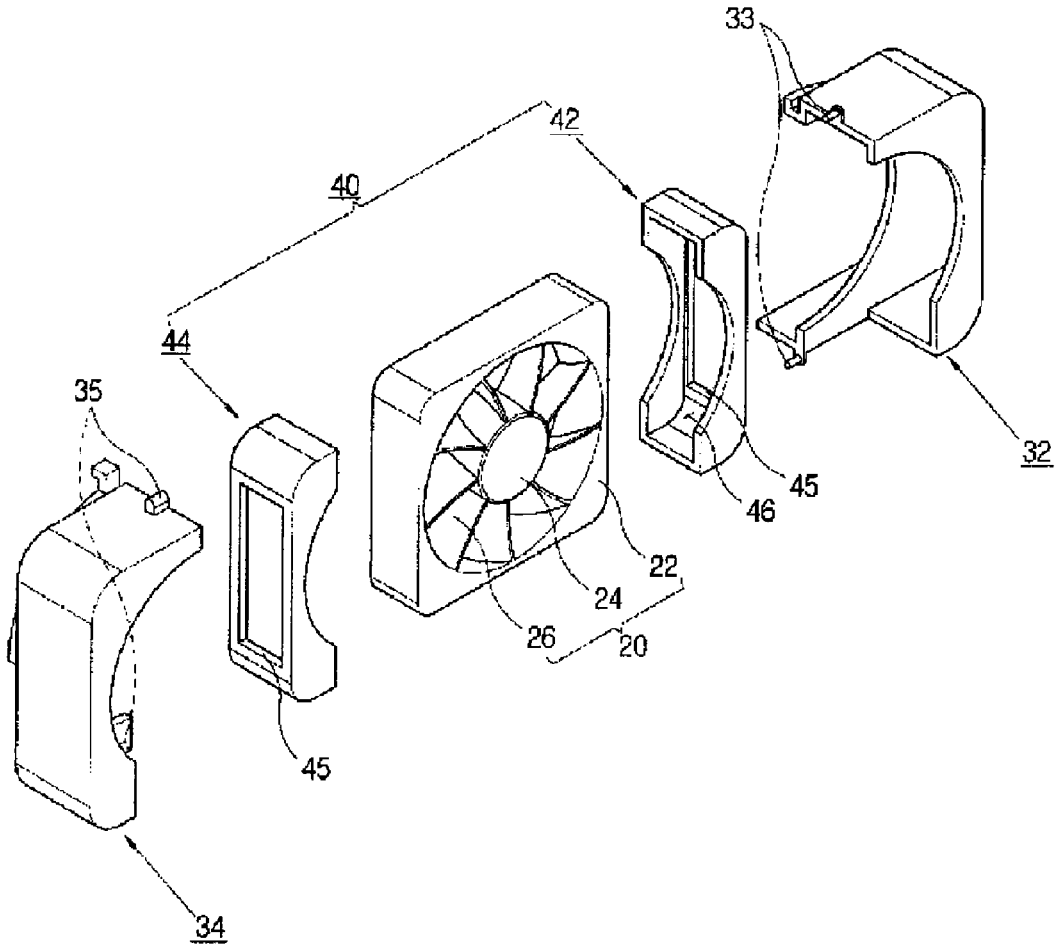
FIG. 2 is an exploded perspective view of the fan assembly of FIG. 1.

As illustrated in FIG. 2, the protrusion 33 is formed at the first supporting case part 32 and the protrusion-accommodating part 35 is formed at the second supporting case part 34. Alternatively, the protrusion 33 may be formed at the second supporting case part 34 and the protrusion-accommodating part 35 may be formed at the first supporting case part 32.

The vibration-proof member 40 can be formed of rubber buffers and dampens the vibration of the fan 20 while being in close contact with the fan 20, thereby preventing the noise from being generated by the vibration of the fan 20.

The vibration-proof member 40 includes a first vibration-proof part 42 that covers one side of the fan 20 and a second vibration-proof part 44 that covers the other side of the fan 20. The first and second vibration-proof parts 42 and 44 are respectively formed with an accommodating portion 46 to accommodate each corner area of the fan 20.

Also, the first and second vibration-proof parts 42 and 44 are respectively formed with an opening 45 passing through each side of the first and second vibration-proof parts 42 and 44.

Since the first and second vibration-proof parts formed of rubber are respectively formed with the opening 45, a contact surface of the fan 20 that generates the vibration is minimized, so that a spring constant is decreased, thereby reducing the noise. Furthermore, since the first and second vibration-proof parts formed of rubber are respectively formed with the opening 45, the vibration is not transmitted to side walls of the supporting case 30, which are relatively thin, but guided to four corner portions of the supporting case 30, which are relatively thick, whereby the vibration can be more effectively screened out or dampened.

An assembling process of the fan assembly is described below.

Both side areas of the fan 20 can be accommodated in the respective accommodating portion 46 of the first and second vibration-proof parts 42 and 44 so that the side areas of the fan 20 are covered by each of the first and second vibration-proof parts 42 and 44.

Then, the first and second supporting case parts 32 and 34 are coupled to each other so as to envelop the fan 20. The first and second supporting case parts 32 and 34 are coupled to each other by engaging the protrusion 33 and the protrusion-accommodating part 35.

Figure 3:
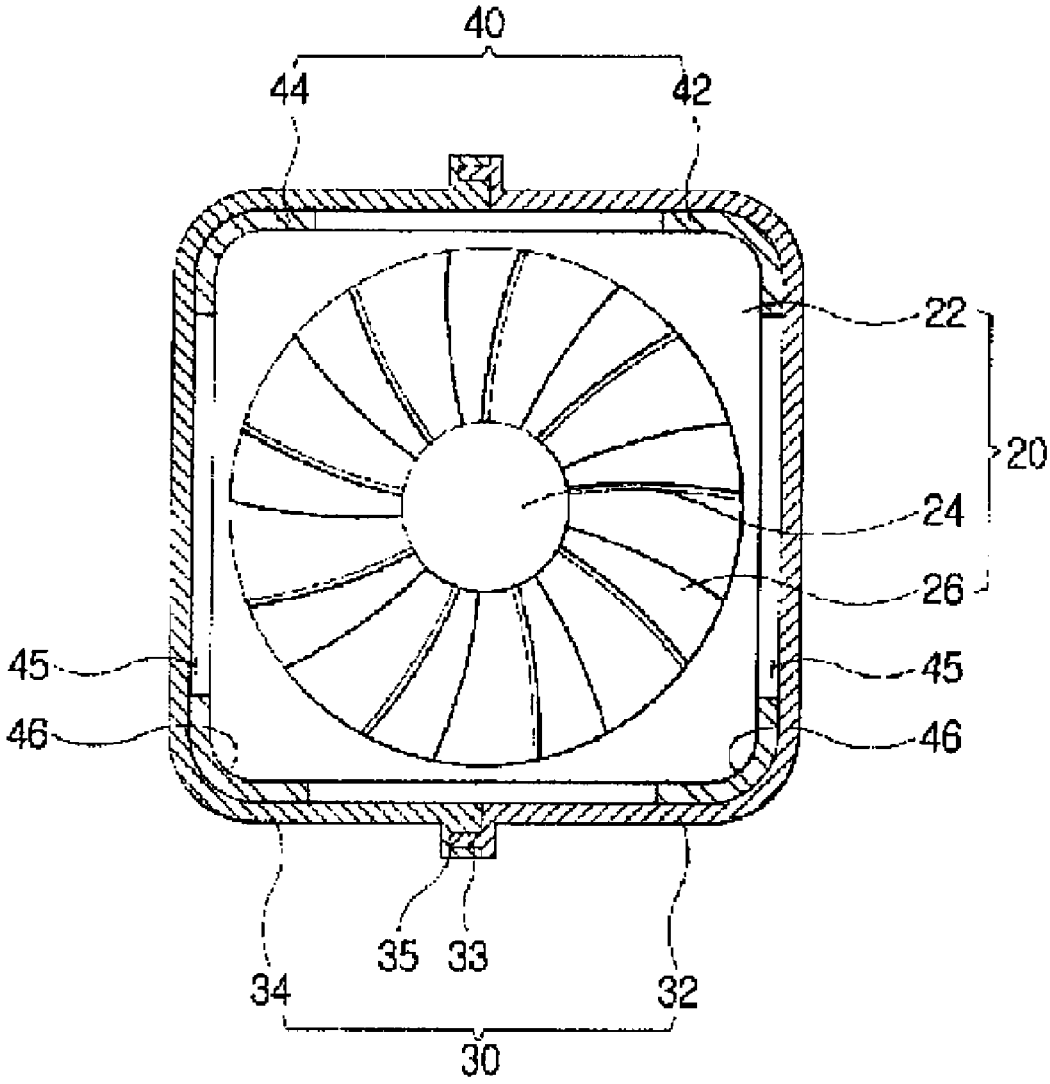
FIG. 3 is a cross-sectional view of the fan assembly of FIG. 1 taken along line III-III.

As illustrated in FIG. 3, the vibration-proof member 40 is interposed between the fan 20 and the supporting case 30, and the vibration generated from the fan 20 is buffered by the vibration-proof member 40. Since the vibration-proof member 40 is formed with the opening 45, the contact surface of the vibration-proof member 40 with the fan 20 is minimized, and thus the spring constant is decreased. Therefore, the vibration is buffered by the vibration-proof member 40 and also guided to the four corner portions of the supporting case 30, which are relatively thick, whereby the vibration is screened out or dampened and the noise is thus reduced.

Figure 4A:
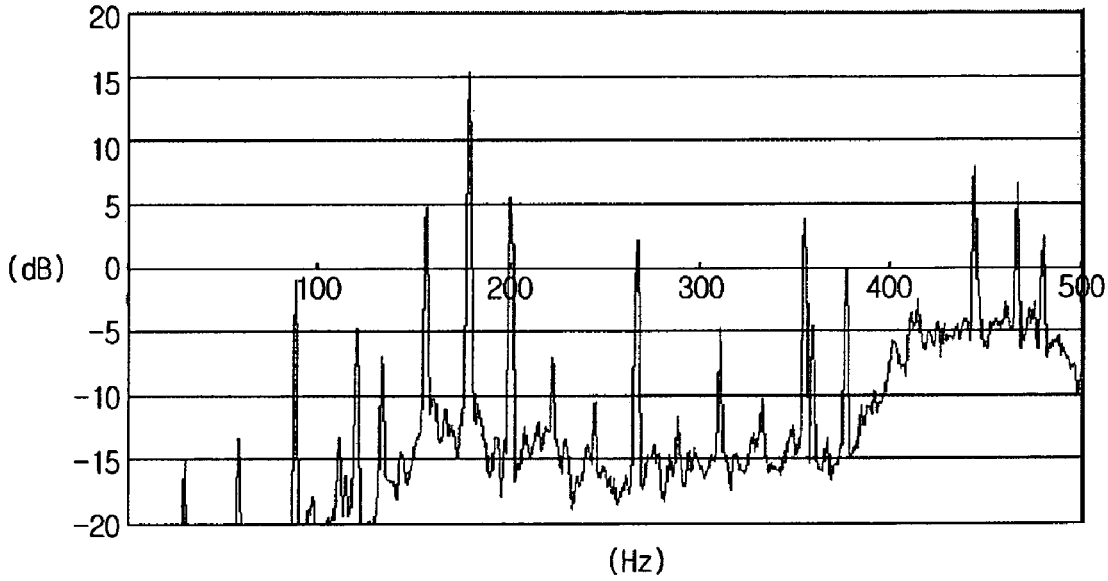
FIG. 4A is a graph illustrating an intensity of noise of a conventional fan assembly.
Figure 4B:
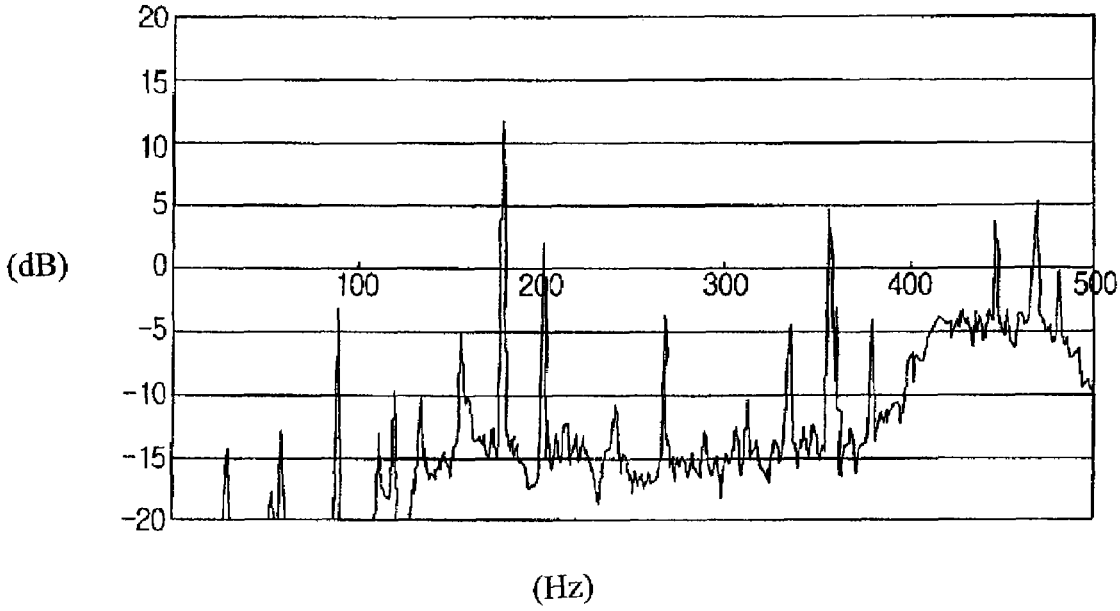
FIG. 4B is a graph illustrating an intensity of noise of a fan assembly according to an embodiment of the present general inventive concept.

Referring to FIGS. 4A and 4B and Table 1 below, measurements confirmed that the fan assembly according to the present embodiment including the vibration-proof member 40 with the opening 45 can noticeable reduce vibration noise compared to a conventional fan assembly including a vibration-proof member without any opening.

FIG. 4A is a frequency spectrum showing noise levels measured in the conventional fan assembly, and FIG. 4B is a frequency spectrum showing the noise levels measured in the fan assembly according to the present embodiment, wherein the x-axis designates a frequency (Hz), and the y-axis is a noise level (measured in decibels, dB).

As illustrated in FIGS. 4A and 4B, the measurements confirm that the fan assembly according to the present embodiment including the vibration-proof member 40 with the opening 45 generally has less vibration noise than the conventional fan assembly including the vibration-proof member without any opening.

In addition, as illustrated by the measurement results in Table 1, a sum of measured noise values of FIG. 4B (in case the opening is not provided) is 23.4 dBA (where dBA denotes that the noise level in dB was measured with an A type filter), and a sum of measured noise values of FIG. 4B (in case the opening is provided) is 22.7 dBA. Therefore, the noise is reduced by 0.7 dBA.

TABLE 1

| Vibration member | Noise (dBA) |
|---|---|
| In case the opening is not provided | 23.4 |
| In case the opening is provided | 22.7 |

According to the present embodiment as described above, since the vibration-proof member 40 having the opening 45 is provided between the fan 20 and the supporting case, the noise generated by the fan 20 can be noticeable reduced compared to that of the conventional fan assembly.

Meanwhile, various embodiments of the fan assembly according to the present general inventive concept can be also mounted to cool heat generating components in various types of apparatuses including an image projecting apparatus.

According to various embodiments of the present general inventive concept, since the noise generated from the fan can be effectively screened out, the vibration noise can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A fan assembly, comprising:

a fan;

a supporting case to support at least a part of the fan along a circumferential direction of the fan; and a vibration dampening member interposed between the fan and the supporting case and having at least one opening passing through a side thereof in a direction perpendicular to an axis of the fan.

2. The fan assembly according to claim 1, wherein the vibration dampening member is formed with an accommodating portion which engages with at least a part of the fan along the circumferential direction of the fan.

3. The fan assembly according to claim 2, wherein the vibration dampening member comprises:

a pair of vibration dampening parts that are respectively coupled to two opposite sides of the fan, and the at least one opening is formed to pass through a lateral surface of each of the vibration dampening parts.

4. The fan assembly according to claim 1, wherein the supporting case comprises a pair of supporting case parts to engage with each other and envelop the fan.

5. The fan assembly according to claim 4, wherein the supporting case further comprises a protrusion provided in one of the pair of supporting case parts, and a protrusion accommodating part provided in the other one thereof to be coupled to the protrusion.

6. The fan assembly according to claim 1, wherein the vibration dampening member is made of a rubber material.

7. An image projecting apparatus, comprising:

a heat generation component; and a fan assembly including:

a fan to cool the heat generating component;

a supporting case to support at least a part of the fan along a circumferential direction of the fan; and a vibration dampening member interposed between the fan and the supporting case and having at least one opening passing through a side thereof in a direction perpendicular to an axis of the fan.

8. The image projecting apparatus according to claim 7, wherein the vibration dampening member of the fan assembly is formed with an accommodating portion which engages with at least a part of the fan along the circumferential direction of the fan.

9. The image projecting apparatus according to claim 8, wherein the vibration dampening member comprises:

a pair of vibration dampening parts that are respectively disposed on two opposite sides of the fan, and the at least one opening is formed to pass through a lateral surface of each of the vibration dampening parts.

10. The image projecting apparatus according to claim 7, wherein the supporting case comprises a pair of supporting case parts to engage with each other and envelop the fan.

11. The image projecting apparatus according to claim 10, wherein the supporting case further comprises a protrusion provided in one of the pair of supporting case parts, and a protrusion accommodating part provided in the other one thereof to be coupled to the protrusion.

12. A fan envelope to support a fan, the fan envelope comprising:

a supporting case to surround and support the fan; and a vibration dampening member to dampen vibrations of the fan, the vibration dampening member being disposed between the fan and the supporting case and having at least one opening passing through a side thereof in a direction perpendicular to an axis of the fan.

13. The fan assembly according to claim 12, wherein the vibration dampening member comprises two vibration dampening member parts covering opposite sides of the fan and the respective adjacent corners.

14. The fan envelope according to claim 13, wherein each vibration dampening member part comprises a sidewall having the at least one opening and accommodating parts corresponding to the adjacent corners.

15. The fan envelope according to claim 14, wherein the accommodating parts are thicker than the sidewall.

16. The fan envelope according to claim 14, wherein the supporting case comprises two case supporting parts that are detachably coupled on opposite sides of the fan.

17. The fan envelope according to claim 16, wherein the case supporting parts are coupled by at least one coupling unit.

18. The fan envelope according to claim 16, wherein each of the vibration dampening member parts corresponds to one of the case supporting parts so that the opposite sides of the fan where the case supporting parts couple are different than the opposite sides of the fan covered by the vibration dampening member parts.

19. The fan envelope according to claim 12, wherein the at least one opening has a rectangular shape.

20. The fan envelope according to claim 12, wherein the vibration dampening member is formed from rubber.

* * * * *

UNITED STATES PATENT AND TRADEMARK OFFICE

CERTIFICATE OF CORRECTION

PATENT NO. : 7,637,717 B2
APPLICATION NO. : 11/427916
DATED : December 29, 2009
INVENTOR(S) : Oh et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 754 days.

Signed and Sealed this

Ninth Day of November, 2010

David J. Kappos

David J. Kappos
*Director of the United States Patent and Trademark Office*